US006925667B2

(12) United States Patent
Cohen

(10) Patent No.: US 6,925,667 B2
(45) Date of Patent: Aug. 9, 2005

(54) ADJUSTABLE DUST RUFFLE

(75) Inventor: Albert Cohen, Malibu, CA (US)

(73) Assignee: Veratex, Inc., Panorama City, CA (US)

( * ) Notice: Subject to any disclaimer, the term of this patent is extended or adjusted under 35 U.S.C. 154(b) by 79 days.

(21) Appl. No.: 10/250,072

(22) Filed: Jun. 2, 2003

(65) Prior Publication Data

US 2004/0237197 A1 Dec. 2, 2004

(51) Int. Cl.[7] ..... A47G 9/00; A47G 9/02
(52) U.S. Cl. ..... 5/493; 24/72.5
(58) Field of Search ..... 5/493, 482; 297/219.1; 24/72.5

(56) References Cited

U.S. PATENT DOCUMENTS

| | | | | | |
|---|---|---|---|---|---|
| 2,245,779 | A | * | 6/1941 | Heil | 5/499 |
| 2,763,875 | A | * | 9/1956 | Piontkowski | 5/493 |
| 4,796,317 | A | | 1/1989 | Kallman et al. | |
| 4,897,891 | A | | 2/1990 | Kallman et al. | |
| 5,086,531 | A | * | 2/1992 | Carlos | 5/493 |
| 5,205,003 | A | | 4/1993 | Green | |
| 5,335,383 | A | | 8/1994 | Schwind | |
| 5,483,712 | A | * | 1/1996 | Greenwood | 5/493 |
| 5,621,931 | A | | 4/1997 | Hamilton | |
| 5,704,082 | A | | 1/1998 | Smith | |
| 5,749,110 | A | | 5/1998 | Gamble et al. | |
| 5,946,750 | A | | 9/1999 | Shiu | |
| 6,151,731 | A | * | 11/2000 | Saparow | 5/493 |
| 6,276,009 | B1 | | 8/2001 | Schrougham | |
| 6,598,249 | B2 | * | 7/2003 | Pajanacci et al. | 5/493 |
| 2003/0028965 | A1 | | 2/2003 | Wootten, Jr. et al. | |

* cited by examiner

*Primary Examiner*—Alexander Grosz
(74) *Attorney, Agent, or Firm*—Blackwell Sanders Peper Martin LLP

(57) ABSTRACT

A dust ruffle for a bed having a box spring and a mattress. The dust ruffle has first, second and third panels, each having a top edge and a bottom edge, the top edge including a plurality of grommets. The top edge of the first, second and third panels is positioned on the box spring between the box spring and mattress. Removable screw pins are inserted through at least some of the plurality of grommets and penetrate the top of the box spring to removably attach the first, second and third panels to the box spring. The first, second and third panels hang vertically from the top edge to cover the box spring and their height is adjustable by adjusting the position of the panels on the box spring prior to insertion of the screw pins.

3 Claims, 6 Drawing Sheets

ADJUSTABLE DUST RUFFLE

BACKGROUND OF INVENTION

The present invention relates generally to a dust ruffle for use on a bed and more particularly to an adjustable dust ruffle that can be used with beds having varying heights.

A conventional bed includes a box spring and mattress. Generally the bed is supported by a bed frame that rests on the floor. In a typical bedroom, the head of the bed abuts a wall and is not seen by people in the bedroom. Therefore, dust ruffles commonly have at least three sides of colorful fabric that can easily be seen by people coming into the bedroom.

Heretofore, the placement of dust ruffles around three sides of a box spring usually required the complete removal of the mattress from the box spring. The dust ruffles of the prior art were affixed to the perimeter of a sheet. This sheet, of a fixed length and width, had to be properly placed between the mattress and the box spring so that the dust ruffles would hang vertically from the sheet and substantially cover the sides of the box spring. Many prior art dust ruffles were only suitable for use with a box spring of a particular length and width. This is because the length and width of the sheet with the dust ruffle had to match the dimensions of the box spring. Even with a properly sized sheet, the placement of the dust ruffle around the box spring was often quite time consuming and tedious. Thus, there is a need for a dust ruffle that is easy to install on the bed.

In addition, many prior art dust ruffles had a fixed length of about 14 Â½ inches from the top of the box spring to the hem. This height is often referred to in the industry as "drop". In today's market, a fixed drop is often unsuitable because box springs are no longer produced to a standard height. This sometimes creates an unsightly gap between the floor and the hem of the dust ruffle when the box springs are higher than normal or leaves the hem with excess material laying on the floor when the box spring is shorter. There is a need for an easily adjustable dust ruffle to provide the desired spacing between the hem of the dust ruffle and the floor on box springs of any height.

Various U.S. patents have issued on dust ruffles including: U.S. Pat. Nos. 4,897,891; 5,205,003; 5,335,383; 5,621,931; 5,749,110; 6,151,731 and 6,276,009. In addition, U.S. Pat. No. 5,946,750 has issued on a Separable Expansion Bed Shield Set.

U.S. Pat. No. 4,796,317 is for a Dust Ruffle For a Bed. This patent discloses attachment means 18' and 18" that are embedded in the box spring. A mesh portion of the dust ruffle engages the attachment means.

U.S. Pat. No. 5,704,082 is for an Anchor Pin for Dust Ruffle. The underside of the anchor has an adhesive that secures the anchor to a flat section of the dust ruffle.

Published U.S. application, US 2003/0028965 A1 published on Feb. 13, 2003, discloses an adjustable bed skirt. The bed skirt is made of multiple panels that include a non-slip portion that is inserted between the mattress and the box spring. The bed skirt also has caps that are positioned at each corner of the bed to close the gaps between adjacent panels. The draped height of the panels can be adjusted by adjusting the amount of material that is inserted between the mattress and the box spring.

SUMMARY OF INVENTION

The dust ruffle of the present invention includes a left side panel, a right side panel and an end panel. A plurality of removable screw pins are provided to secure the panels to the box spring. The panels cover three sides of the box spring and the bed frame. The panels may be adjusted up or down so the hem of the ruffle is substantially parallel and adjacent to the floor. In addition, each panel may include a pleat on at least one end of the panel that expands to wrap around the corners of the box spring to improve the visual appearance of the bed. During installation of the present dust ruffle, it is not necessary to remove the mattress from the box spring to install the panels. To change the present dust ruffle, the screw pins can be easily removed and the panels taken off the bed. No adhesives are required so the screw pins can be easily removed from both the box spring and the dust ruffle. With the screw pins removed, the panels can be easily removed from the box spring, cleaned and replaced or another dust ruffle can be installed.

DETAILED DESCRIPTION

Figure 1:
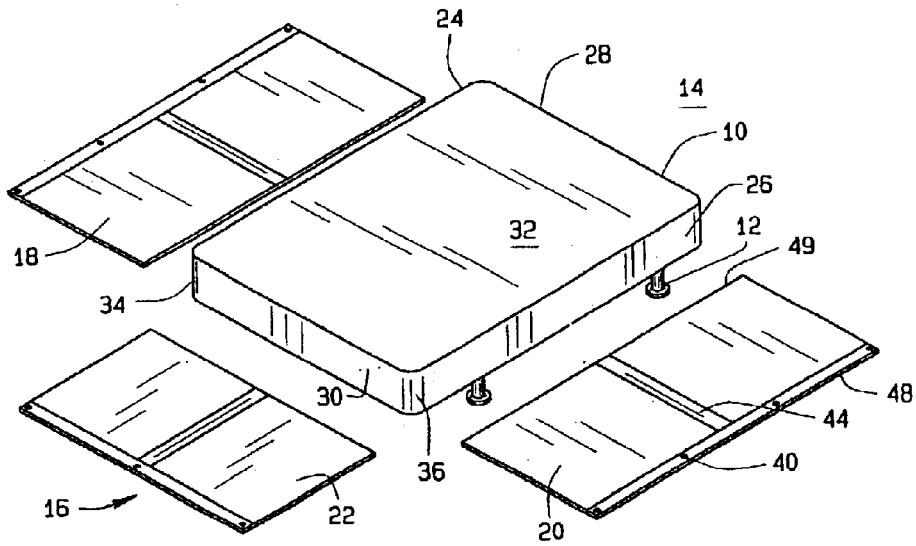
FIG. 1 is a perspective view of a box spring supported on a bed frame and the three panels of the dust ruffle.

The term bed as used herein means a box spring and mattress. Referring to FIG. 1, a box spring 10 is mounted on a bed frame 12 that rests on the floor 14. The mattress has been removed and is not shown in FIG. 1 for clarity. In actual practice, the mattress rests on the box spring 10 and the present dust ruffle is installed between the box spring and the mattress.

The present dust ruffle, generally identified by the numeral 16, is shown laying upon the floor 14 ready for installation on the box spring 10. Dust ruffle 16 includes left side panel 18, right side panel 20 and end panel 22. The panels, a flat cloth having a generally elongate rectangular shape, have a top edge 48, a bottom edge 49 and a vertical edge at each end of the panel and include a plurality of grommets 40 generally located along the top edge 48 of the panel. The panels 18, 20 and 22 include pleats or folds 44 that extend from near the top edge 48 of each panel to the bottom edge 49 of each panel and are generally located near the center or mid-point of the panels, although the location is not critical. The panels 18, 20 and 22 also include a pleat or fold 46, shown in detail in FIGS. 4–6, along at least one of the vertical edges of the panel. The pleats 44 and 46 are inverted, folded to be behind the panel, between the panel and the box spring 10, when the panel is in place on the box spring 10. These three panels 18, 20 and 22 are removeably attached to the box spring 10 by a plurality of removable screw pins, better seen in subsequent figures. The box spring 10 has a left side wall 24, a right side wall 26, a head wall 28 and a foot wall 30. A top 32 joins all the walls, 24, 26, 28 and 30. A left corner 34 is formed at the juncture of the left side wall 24 and the foot wall 30. A right corner 36 is formed at the juncture of the right side wall 26 and the foot wall 30.

Figure 2:
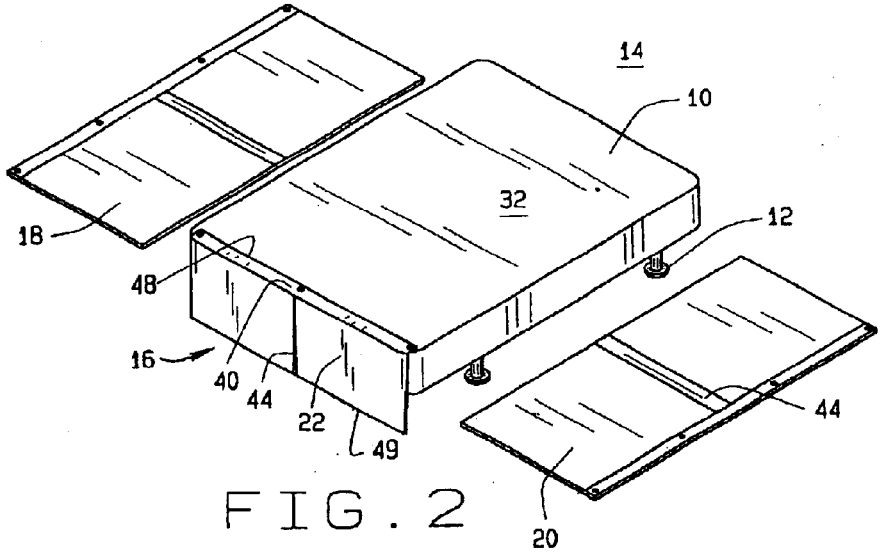
FIG. 2 is a perspective view of the box spring with the end panel in place and the left and right side panels on the floor.

FIG. 2 is a perspective view of the box spring 10 with the end panel 22 in place on the box spring 10. The long edge or top edge 48 of the end panel 22, including a plurality of grommets 40, is positioned on the top 32 of the box spring 10 and the end panel 22 hangs vertically from the top edge 48 to cover the foot wall 30 of the box spring 10. A plurality of removable screw pins 42 will be inserted through at least some of the plurality of grommets 40 and penetrate box spring 10, as shown in more detail in FIGS. 10 and 11, to removably attach the panel 22 to the box spring 10. While a screw pin may be inserted through each grommet, it is not necessary. The bottom edge 49 of the end panel 22 is adjusted to be substantially parallel and adjacent to the floor 14 by moving the top edge 48 into or away from the middle of top 32 of box spring 10. Pleat 44, in or near the center of end panel 22, provides flexibility, allowing motion of the panel while in place on the box spring 10. In this figure, the left side panel 18 and right side panel 20 are laying on the floor 14, prior to installation.

Figure 3:
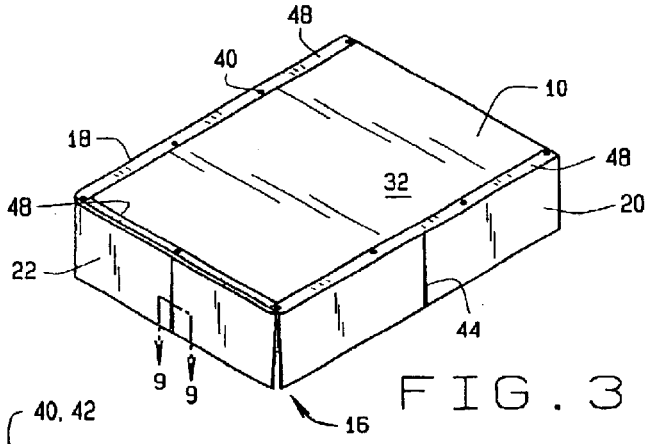
FIG. 3 is a perspective view of the box spring with the three panels of the dust ruffle in place.

FIG. 3 is a perspective view of the box spring 10 with the three panels 18, 20 and 22 in place. The top edge 48 of each panel, including a plurality of grommets 40, is positioned on the top 32 of box spring 10. A plurality of removable screw pins 42 will be inserted through at least some of the plurality of grommets 40 and penetrate box spring 10, as shown in more detail in FIGS. 10 and 11, to removably attach the panels 18, 20 and 22 to the box spring 10. The panels 18, 20 and 22 hang vertically from the top edge 48 to cover the left wall 24, right wall 26 and foot wall 30 of box spring 10 respectively. The bottom edges 49 of the panels 18, 20 and 22 are adjusted to be substantially parallel and adjacent to the floor 14. Pleats 44 near the center of each panel provide flexibility, allowing motion of the panels while in place on the box spring 10.

Figure 4:
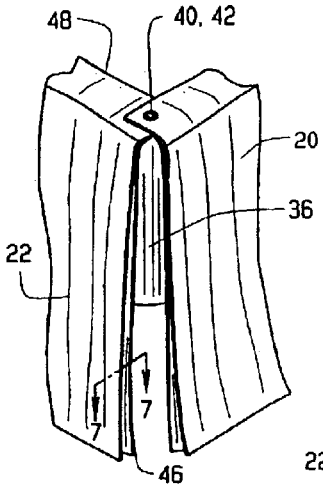
FIG. 4 is a perspective view of a corner of the box spring before the pleats are expanded.

FIG. 4 is a perspective view of right corner 36 of box spring 10 before the pleats 46 are expanded. The top edge 48 of right side panel 20 is shown overlapping the top edge 48 of end panel 22 at right corner 36, but their relative position can be reversed if desired. One of the plurality of grommets 40 in the top edge 48 of right side panel 20 overlaps a grommet in the top edge 48 of end panel 22 and a removable screw pin 42 is inserted through the overlapped grommets 40 and penetrates the top 32 of box spring 10, as shown in more detail in FIGS. 10 and 11, to removably attach the panels 20 and 22 to the box spring 10. Pleats 46, shown extended in FIGS. 5 and 6, are folded along the vertical edges of the panels 20 and 22 allowing corner 36 of box spring 10 to be seen.

Figure 5:
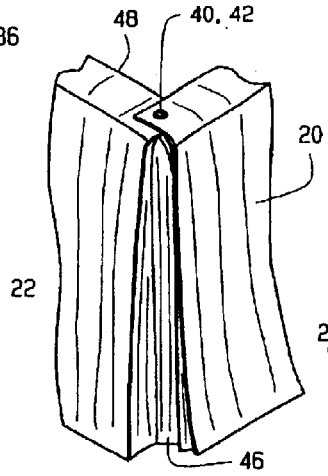
FIG. 5 is a perspective view of a corner of the box spring after the pleat from one panel is expanded.

FIG. 5 is the same perspective view as shown in FIG. 4 after the pleat 46 positioned along the vertical edge of end panel 22 is expanded. The pleat 46 is expanded by opening the pleat and positioning the free edge of the pleat behind the vertical edge of right side panel 20. With the pleat 46 expanded, the corner 36 of the box springs 10 is hidden from view.

Figure 6:
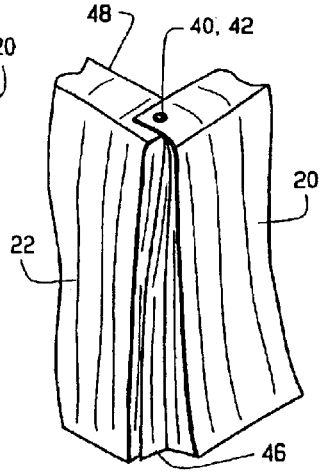
FIG. 6 is a perspective view of a corner of the box spring after the pleats from both panels are expanded.

FIG. 6 is the same perspective view as shown in FIGS. 4 and 5 after the pleats 46 positioned along the vertical edge of both right side panel 20 and end panel 22 are expanded. The pleats 46 are expanded by opening the pleat 46 on the vertical edge of end panel 22 as shown in FIG. 5, then opening the pleat 46 on the vertical edge of right side panel 20 and covering the expanded pleat from end panel 22 to provide two layers of cloth to more fully hide the corner 36 of box springs 10 from view.

Figure 7:
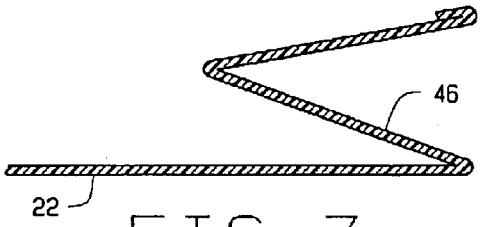
FIG. 7 is a section view of a pleat taken along section line 7—7 in FIG. 4.

FIG. 7 is a section view of a pleat or fold 46 taken along section line 7—7 in FIG. 4. The pleat 46, located along the vertical edge of end panel 22, is shown partially expanded. While the pleat 46 shown in FIG. 7 is located along the vertical edge of end panel 22, side panels 18 and 20 also include a similar pleat or fold 46 along at least one of the vertical edges of the panel.

Figure 8:
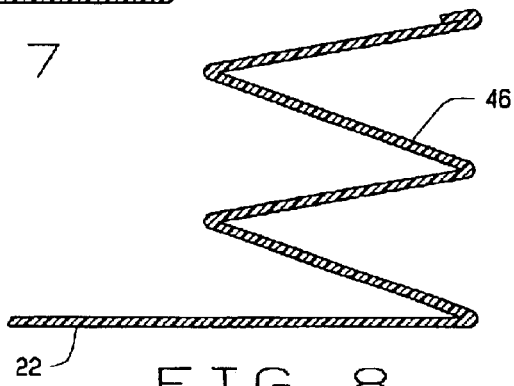
FIG. 8 is a section view of an alternate configuration of a pleat taken along section line 7—7 in FIG. 4.

FIG. 8 is a section view of an alternate configuration of pleat or fold 46 taken along section line 7—7 in FIG. 4. The pleat 46, located along the vertical edge of end panel 22, is shown partially expanded. While the pleat 46 shown in FIG. 7 is located along the vertical edge of end panel 22, side panels 18 and 20 also include a similar pleat or fold 46 along at least one of the vertical edges of the panel.

Figure 9:
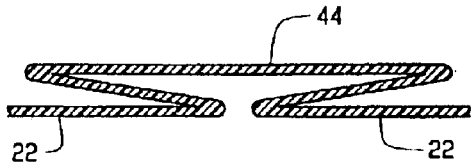
FIG. 9 is a section view of a pleat positioned in the middle of a panel taken along section line 9—9 in FIG. 3.

FIG. 9 is a section view of a pleat or fold 44 taken along section line 9—9 in FIG. 3. While the pleat 44 shown in FIG. 9 is located near the center of end panel 22, side panels 18 and 20 also include pleats or folds 44 that extend from near the top edge 48 of each panel to the bottom edge 49 of each panel and are generally located near the center of the panels, although the location is not critical.

Figure 10:
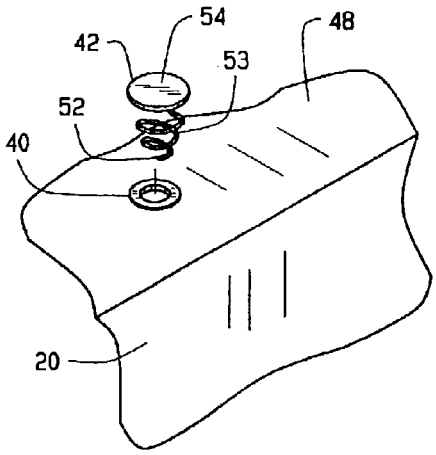
FIG. 10 is an enlarged view of a screw pin illustrating the cooperative relationship between the screw pin and a grommet in a panel.

FIG. 10 is an enlarged view of a screw pin 42 prior to being inserted through grommet 40 in the top edge 48 of right side panel 20 and penetrating the top 32 of box spring 10, not shown. While right side panel 20 is shown, the use of screw pin 42 to attach left side panel 18 and end panel 22 to box spring 10 would be the same. The number and placement of the screw pins 42 can vary, provided that a sufficient number are used to hold the panels 18, 20 and 22 in place on the box spring 10. The screw pin 42 is produced by a number of vendors including The Knobby Crafters of Attleboro, Mass. The screw pin 42 is also sometimes referred to in the trade as twist pins; however, for purposes of this application, they will simply be referred to as screw pins. The screw pin 42 has a sharp point 52 on the end of a spiral shaft 53. The sharp point is capable of penetrating the top 32 of the box spring 10. A head 54 is formed at the end of the spiral shaft 53 opposite the sharp point 52. The head 54 is large enough to be easily grasped between the fingers and rotated so the spiral shaft 53 bites into the top 32 of the box spring 10. The spiral shaft 53 is inserted through a grommet 40 in the top edge 48 of right side panel 20 and, as the head 54 is rotated clockwise, the removable screw pin 42 penetrates the top 32 of the box spring 10 and draws the head 54 towards the top edge 48 of the panel 20 to removably attach the top edge 48 of panel 20 to the box spring 10. As the head 54 is rotated counter-clockwise, the screw pin 42 will disengage from the box spring 10 and it can then be removed from the grommet 40 to allow the panel 20 to be removed from the box spring 10 for cleaning or replacement.

Figure 11:
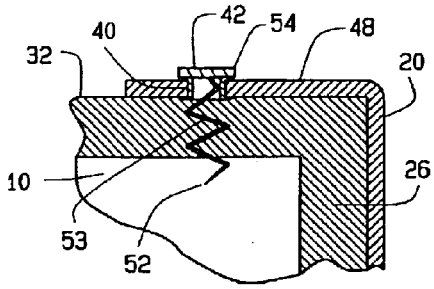
FIG. 11 is an enlarged view of a screw pin inserted through a grommet to attach a panel to a box spring.

FIG. 11 is an enlargement of the screw pin 42 of FIG. 10 after being inserted through a grommet 40 in the top edge 48 of the right side panel 20 and penetrating the box spring 10. The screw pin 42 has been turned clockwise and the sharp point 52 and the spiral shaft 53 have passed through grommet 40 in the top edge 48 of right side panel 20 and also penetrated the top 32 of the box spring 10. Right side wall 20 hangs vertically from top edge 48 to cover the right side wall 26 of box spring 10.

Figure 12:
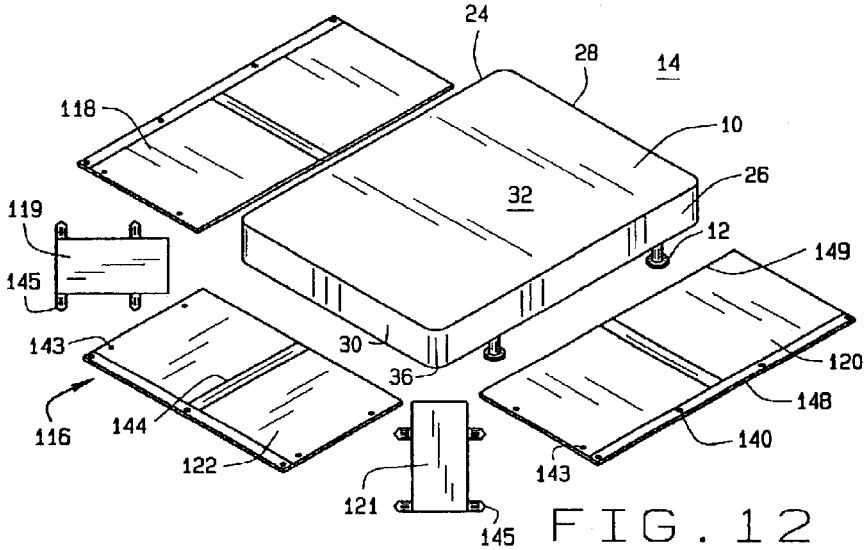
FIG. 12 is a perspective view of the box spring and the panels of an alternate configuration of the dust ruffle.

FIG. 12 is a perspective view of the box spring 10 and an alternate configuration of a dust ruffle 116. As in FIG. 1, a box spring 10 is mounted on a bed frame 12 that rests on the floor 14. The mattress has been removed and is not shown in FIG. 12 for clarity. In actual practice, the mattress rests on the box spring 10 and the present dust ruffle 116 is installed between the box spring 10 and the mattress. This alternate configuration of the present dust ruffle is shown laying upon the floor 14 ready for installation on the box spring 10. Dust ruffle 116 includes left side panel 118, left corner panel 119, right side panel 120, right corner panel 121 and end panel 122. The panels have a top edge 148 and a bottom edge 149 and include a plurality of grommets 140 generally located along the top edge 148 of the panel. The panels 118, 120 and 122 include pleats or folds 144 that extend from near the top edge 148 of each panel to the bottom edge 149 of each panel and are generally located near the center of the panels, although the location is not critical. Pleat 144 provides flexibility allowing motion of the panel when it is attached to the box spring 10. The panels 118, 120 and 122 also include fasteners 143, such as, for example, buttons, snaps, hooks and Velcro patches, along at least one of the vertical edges of the panel. These three panels 118, 120 and 122 are removeably attached to the box spring 10 by a plurality of removable screw pins 142, better seen in previous figures. The box spring 10 has a left side wall 24, a right side wall 26, a head wall 28 and a foot wall 30. A top 32 joins all the walls, 24, 26, 28 and 30. A left corner 34 is formed at the juncture of the left side wall 24 and the foot wall 30. A right corner 36 is formed at the juncture of the right side wall 26 and the foot wall 30. Left corner panel 119 includes tabs or flaps 145 and is removably attached between left side panel 118 and end panel 122 with fasteners 143 and tabs 145 to cover left corner 34 when dust ruffle 116 is attached to box spring 10. Similarly, right corner panel 121 includes tabs or flaps 145 and is removably attached between right side panel 120 and end panel 122 with fasteners 143 and tabs 145 to cover right corner 36 when dust ruffle 116 is attached to box spring 10.

Figure 13:
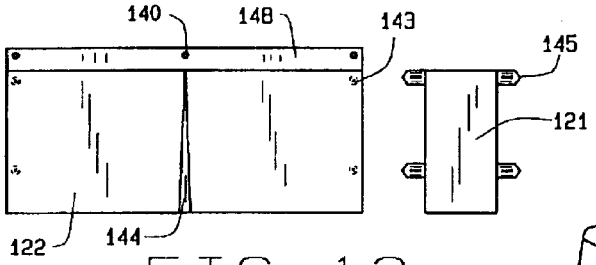
FIG. 13 is another view illustrating the relationship between a side panel and a corner panel of the alternate configuration of the dust ruffle shown in FIG. 12.

FIG. 13 is another view better illustrating the relationship between a side panel and a corner panel. End panel 122 is shown with right corner panel 121. End panel 122 has top edge 148 and pleat 144, as described in previous figures, and includes fasteners 143 along the vertical edge. Right corner panel 121 includes tabs 145 that cooperate with fasteners 143 to removably attach right corner panel 121 to end panel 122.

Figure 14:
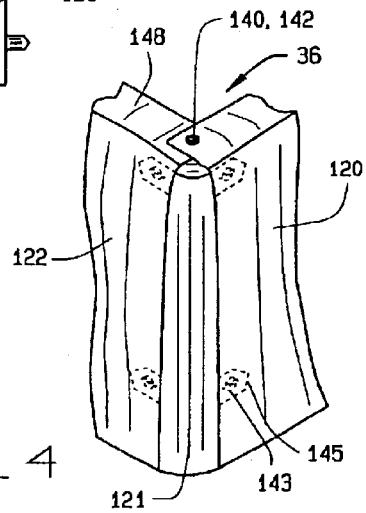
FIG. 14 is a perspective view of a corner of the box spring after the panels of the alternate configuration of the dust ruffle shown in FIG. 12 are in place.

FIG. 14 is a perspective view of a corner of the box spring 10 after panels of the alternate configuration of the dust ruffle 116 of FIG. 12 are in place. The top edge 148 of right side panel 120 is shown overlapping the top edge 148 of end panel 122 at the right corner 36 of box spring 10, but their relative position can be reversed if desired. One of the plurality of grommets 140 in the top edge 148 of right side panel 120 overlaps a grommet in the top edge of end panel 122 and a removable screw pin 142 is inserted through the overlapped grommets 140 and penetrates the top 32 of box spring 10, as shown in more detail in FIGS. 10 and 11, to removably attach the panels 120 and 122 to the box spring 10. Tabs 145 on right corner panel 121 cooperate with fasteners 143 on end panel 122 and right side panel 120 to attach right corner panel 121 between end panel 122 and right side panel 120 to cover right corner 36 of box springs 10.

Figure 15:
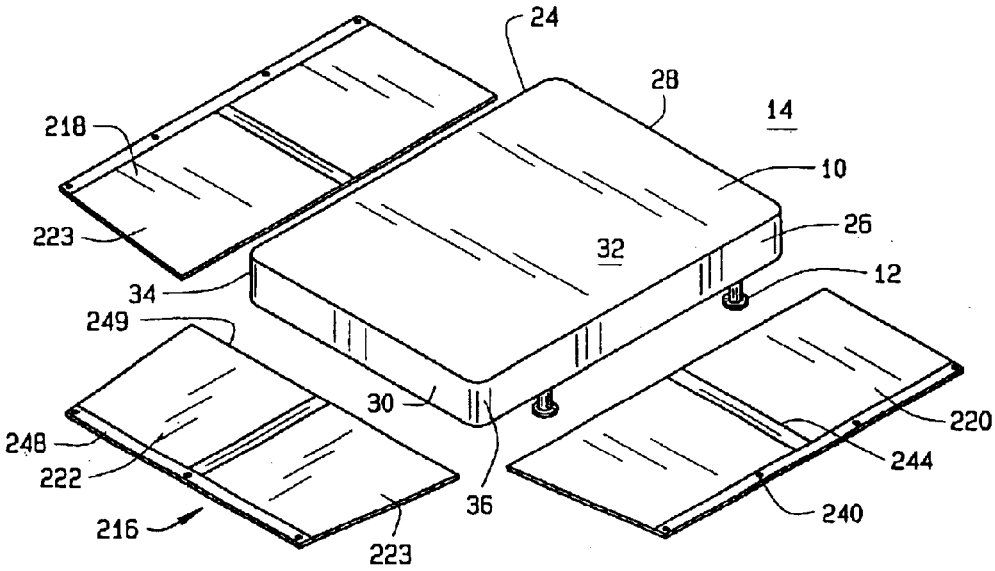
FIG. 15 is a perspective view of a box spring and the panels of a second alternate configuration of the dust ruffle.

In FIG. 15 a perspective view of the box spring 10 and a second alternate configuration of a dust ruffle 216 is shown. As in FIG. 1, a box spring 10 is mounted on a bed frame 12 that rests on the floor 14. The mattress has been removed and is not shown in FIG. 15 for clarity. In actual practice, the mattress rests on the box spring 10 and the present dust ruffle 216 is installed between the box spring 10 and the mattress. This alternate configuration of the present dust ruffle is shown laying upon the floor 14 ready for installation on the box spring 10. Dust ruffle 216 includes left side panel 218, right side panel 220 and end panel 222. The panels are trapazoidal in shape, having a top edge 248 and a bottom edge 249 that is wider than the top edge 248 creating a corner portion 223 of the panel, and include a plurality of grommets 240 generally located along the top edge 248 of the panel. The panels 218, 220 and 222 include pleats or folds 244 that extend from near the top edge 248 of each panel to the bottom edge 249 of each panel and are generally located near the center of the panels, although the location is not critical. Pleats 244 provide flexibility, allowing motion of the panel when it is attached to the box spring 10. These three panels 218, 220 and 222 are removeably attached to the box spring 10 by a plurality of removable screw pins 242, better seen in previous figures. The box spring 10 has a left side wall 24, a right side wall 26, a head wall 28 and a foot wall 30. A top 32 joins all the walls, 24, 26, 28 and 30. A left corner 34 is formed at the juncture of the left side wall 24 and the foot wall 30. A right corner 36 is formed at the juncture of the right side wall 26 and the foot wall 30. When the panels 218, 220 and 222 are attached to the box spring 10, the corner portions 223 of the panels are wrapped around the corners 34 and 36 of the box spring 10 to cover the corners from view.

Figure 16:
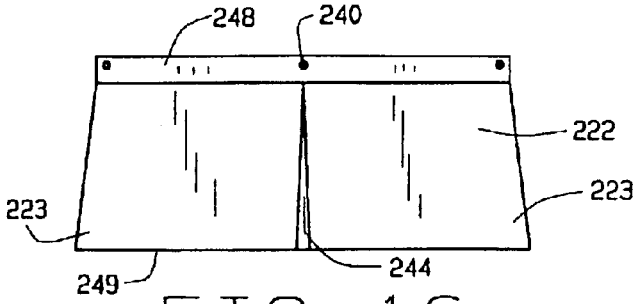
FIG. 16 is an enlarged view illustrating the shape of the panels of the second alternate configuration shown in FIG. 15.

FIG. 16 is an enlarged view illustrating the trapazoidal shape of the panels 218, 220 and 222 of the second alternate configuration of the dust ruffle 216. End panel 222 is shown, but side panels 218 and 220 have the same shape. End panel has a top edge 248 and a bottom edge 249 that is wider than the top edge 248 creating a corner portion 223 of the panel, and includes a plurality of grommets 240 generally located along the top edge 248 of the panel. The panel 222 includes pleats or folds 244 that extend from near the top edge 248 of the panel to the bottom edge 249 of the panel and are generally located near the center of the panels, although the location is not critical.

Figure 17:
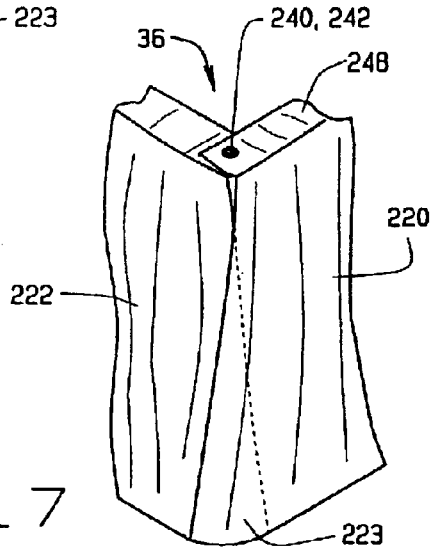
FIG. 17 is a perspective view of a corner of the box spring after the panels of the second alternate configuration of the dust ruffle shown in FIG. 15 are in place.

FIG. 17 is a perspective view of a corner of the box spring 10 after panels of the second alternate configuration of the dust ruffle 216 of FIG. 15 are in place. The top edge 248 of right side panel 220 is shown overlapping the top edge 248 of end panel 222 at the right corner 36 of box spring 10, but their relative position can be reversed if desired. One of the plurality of grommets 240 in the top edge 248 of right side panel 220 overlaps a grommet in the top edge of end panel 222 and a removable screw pin 242 is inserted through the overlapped grommets 240 and penetrates the top 32 of box spring 10, as shown in more detail in FIGS. 10 and 11, to removably attach the panels 220 and 222 to the box spring 10. A corner portion 223 of end panel 222 is wrapped around corner 36 and corner portion 223 of right side panel 220 is also wrapped around corner 36 overlapping corner portion 223 of end panel 222 to completely cover corner 36 of box springs 10 with two layers of material.

Figure 18:
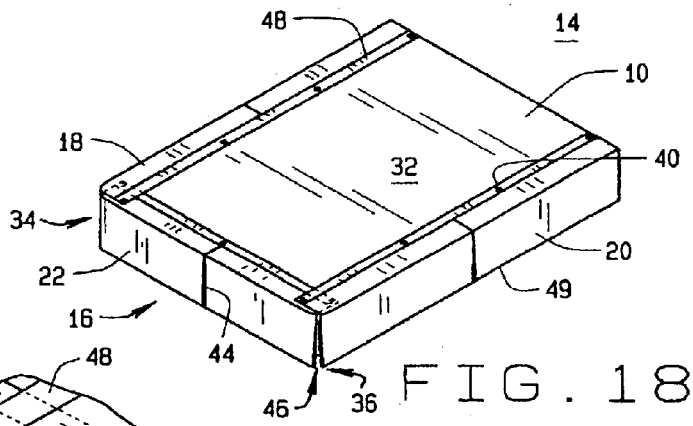
FIG. 18 is a perspective view of the box spring and panels of FIGS. 1 and 3 showing an alternate configuration of the three panels of the dust ruffle in place on a box spring that is shorter than normal.

FIG. 18 is a perspective view of the box spring 10 with the three panels 18, 20 and 22 of FIGS. 1 and 3 in place showing an alternate configuration of the installation of the dust ruffle 16 in which a shorter box spring 10 is used. The top edge 48 of each panel 18, 20 and 22, including a plurality of grommets 40, is positioned on the top 32 of box spring 10. A plurality of removable screw pins 42 will be inserted through the plurality of grommets 40 and penetrate box spring 10, as shown in more detail in FIGS. 10 and 11, to removably attach the panels 18, 20 and 22 to the box spring 10. The panels 18, 20 and 22 hang vertically from the top edge 48 to cover the left wall 24, right wall 26 and foot wall 30 of the box spring 10 respectively. The position of the top edge 48 of each panel 18, 20 and 22 on the top 32 of box spring 10 is adjusted by moving the top edge toward or away from the center of the top 32 so that the bottom edges 49 of the panels 18, 20 and 22 are substantially parallel and adjacent to the floor 14. In this FIG. 18, when compared to FIG. 3, the box spring is shorter and the top edges 48 of the panels 18, 20 and 22 have been moved toward the center of top 32 of box spring 10 to provide the desired spacing between the bottom edge 49 of the panels 18, 20 and 22 and the floor 14. The panels 18, 20 and 22 include pleats or folds 44 that extend from near the top edge 48 of each panel to the bottom edge 49 of each panel and are generally located near the center of the panels, although the location is not critical. The panels 18, 20 and 22 also include a pleat or fold 46, shown in detail in FIGS. 19–21, along at least one of the vertical edges of the panel. Pleats 44 and 46 provide flexibility, allowing motion of the panels while in place on the box spring 10 and pleats 46, in addition, expand to cover corners 34 and 36 of box spring 10.

Figure 19:
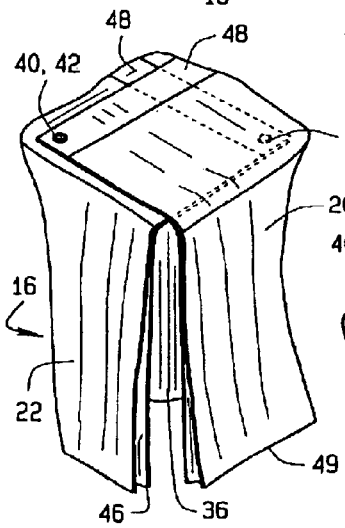
FIG. 19 is a perspective view of a corner of the box spring of FIG. 18 showing the alternate configuration of the panels of the dust ruffle before the pleats are expanded.

FIG. 19 is a perspective view of right corner 36 of box spring 10 showing an alternate configuration of the installation of the dust ruffle 16 of FIG. 18 before the pleats 46 are expanded. The box spring 10 is shorter and the top edges 48 of panels 20 and 22 have been moved toward the center of top 32 of box spring 10 to provide the desired spacing between the bottom edge 49 of the panels 20 and 22 and the floor 14. When the top edges 48 of panels 20 and 22 are moved toward the center of top 32, the panels 20 and 22 have a greater overlap at the corners of the box spring 10 and the grommets in one panel do not overlap with the grommets in the other panel, as shown in this FIG. 19. The top edge 48 of right side panel 20 is shown overlapping the top edge 48 of end panel 22 at right corner 36, but their relative position can be reversed if desired. One of the plurality of grommets 40 in the top edge 48 of right side panel 20 and in the top edge of end panel 22 is shown. A removable screw pin 42 is inserted through the grommet 40 in the uppermost panel and penetrates the fabric of the overlapped panel and the top 32 of box spring 10, as shown in more detail in FIGS. 10 and 11, to removably attach the panels 20 and 22 to the box spring 10. Pleats 46, shown extended in FIGS. 20 and 21, are folded along the vertical edges of the panels 20 and 22 allowing right corner 36 of box spring 10 to be seen.

Figure 20:
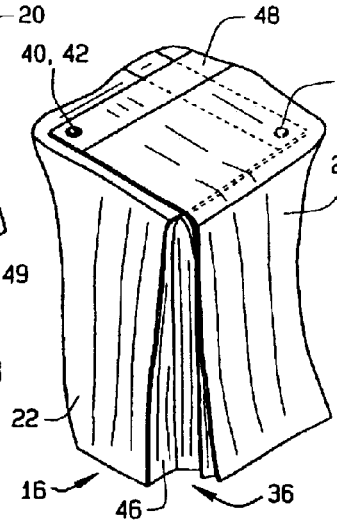
FIG. 20 is a perspective view of a corner of the box spring of FIG. 18 showing the alternate configuration of the panels of the dust ruffle after the pleat from one panel is expanded.

FIG. 20 is the same perspective view as shown in FIG. 19 after the pleat 46 positioned along the vertical edge of end panel 22 is expanded. The pleat 46 is expanded by opening the pleat and positioning the free edge of the pleat behind the vertical edge of right side panel 20. With the pleat 46 expanded, the corner 36 of the box springs 10 is hidden from view.

Figure 21:
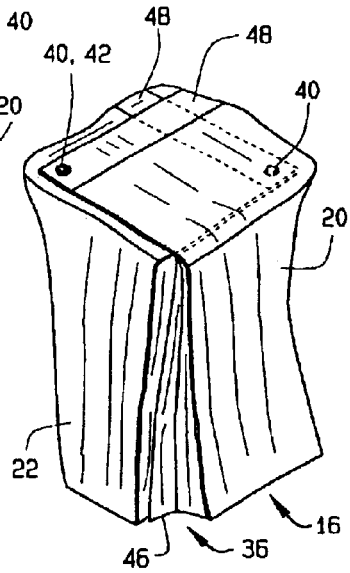
FIG. 21 is a perspective view of a corner of the box spring of FIG. 18 showing the alternate configuration of the panels of the dust ruffle after the pleats from both panels are expanded.

FIG. 21 is the same perspective view as shown in FIGS. 19 and 20 after the pleats 46 positioned along the vertical edge of both right side panel 20 and end panel 22 are expanded. The pleats 46 are expanded by opening the pleat 46 on the vertical edge of end panel 22 as shown in FIG. 20, then opening the pleat 46 on the vertical edge of right side panel 20 and covering the expanded pleat from end panel 22 to provide two layers of cloth to more fully hide the corner 36 of box springs 10 from view.

The three panels can be installed in any order. To install the dust ruffle 16 as shown in FIGS. 3 and 18, the end panel 22 is installed before the left side panel 18 and the right side panel 20. However, the side panels 18 and 20 may be installed before the end panel 22 and, if the owner desired a hybrid of these two configurations could also be installed. Again, the order in which the three panels are installed is a matter of owner preference.

To install the dust ruffle 16 as shown in FIGS. 3 and 18, the top edges 48 of left side panel 18 and right side panel 20 and end panel 22 should be slipped between the top 32 of box spring 10 and the mattress. It is not necessary to remove the mattress to install the present dust ruffle. The top edge 48 of each panel 18, 20 and 22 should be adjusted so the bottom edges 49 of the panels are substantially parallel and adjacent the floor and pleats 46 should be expanded to cover corners 34 and 36 of the box spring 10. Removable screw pins 42 can then be inserted through some of the grommets 40 in the top edges 48 of the panels 18, 20 and 22 to penetrate top 32 of the box spring 10 to hold the panels in place.

To change the dust ruffle 16, all screw pins 42 must first be removed. Because there are no adhesives, this is a simple task. The three panels 18, 20 and 22 can then be pulled from the bed to be cleaned and replaced or another dust ruffle can be installed.

While several embodiments of the present invention have been shown and described, it will be obvious to those skilled in the art that many modifications may be made to the present invention without departing from the spirit and scope thereof.

What is claimed is:

1. A dust ruffle for a bed having a box spring and a mattress, the dust ruffle comprising:

a left side panel, a right side panel and an end panel, each panel having a top edge, a bottom edge and a vertical edge on each end of the panel, the top edge of each panel including a plurality of grommets, the left side panel, the right side panel and the end panel having a first inverted pleat along at least one of the vertical edges and a second inverted pleat extending from the top edge to the bottom edge, the pleat being located near a mid-point of the panel, the top edge of the left side panel, the right side panel and the end panel being adjustably positioned on the box spring between the box spring and mattress, and a plurality of removable screw pins inserted through at least some of the plurality of grommets and penetrating the top of the box spring to removably attach the left side panel, the right side panel and the end panel to the box spring, wherein the left side panel, the right side panel and the end panel hang vertically from their top edges to cover the box spring.

2. The dust ruffle for a bed of claim 1 wherein the top edge of the left side panel, the right side panel and the end panel are adjustably positioned on the box spring between the box spring and mattress to adjustably position the bottom edge of the left side panel, the right side panel and the end panel substantially parallel and adjacent to the floor.

3. A method for installing a dust ruffle on a bed which rests on a bed frame that sits on a generally horizontal floor, the bed having a box spring and a mattress, the box spring having a top joining a left side wall, a right side wall, a head wall and a foot wall, the juncture of the left side wall and the foot wall defining a left corner and the juncture of the right side wall and the foot wall defining a right corner, the dust cover having first, second and third elongate, rectangular panels having a top edge, a bottom edge and a vertical edge on each end of the panel each panel comprising a first inverted pleat along at least one of its vertical edges, and a second inverted pleat extending from the top edge to the bottom edge, the second pleat being located near a mid-point of the panel, the top edge of each panel including a plurality of grommets, the method for installing the dust cover comprising:

inserting the top edge of the first panel in between the top of the box spring and the mattress whereby the first panel hangs vertically adjacent the left side wall of the box spring, wrapping a pleat from the vertical edge of the first panel around the left corner of the box spring, adjusting the bottom edge of the first panel to be substantially parallel and adjacent to the floor so the first panel covers the left side wall and left corner of the box spring, inserting a plurality of removable screw pins through the grommets at the top edge of the first panel and the top of the box spring to removably attach the first panel to the box spring, inserting the top edge of the second panel in between the top of the box spring and the mattress whereby the second panel hangs vertically adjacent the right side wall of the box spring, wrapping a pleat from the vertical edge of the second panel around the right corner of the box spring, adjusting the bottom edge of the second panel to be substantially parallel and adjacent to the floor so the second panel covers the right side wall and right corner of the box spring, inserting a plurality of removable screw pins through the grommets at the the top edge of the second panel and the top of the box spring to removably attach the second panel to the box spring, inserting the top edge of the third panel in between the top of the box spring and the mattress whereby the third panel hangs vertically adjacent the foot wall of the box spring, wrapping a pleat from the vertical edges of the third panel around the left corner and the right corner of the box spring, adjusting the bottom edge of the third panel to be substantially parallel and adjacent to the floor so the third panel covers the foot wall, the left corner and the right corner of the box spring, and inserting a plurality of removable screw pins through the grommets at the top edge of the third panel and the top of the box spring to removably attach the third panel to the box spring.

* * * * *